US005573242A

United States Patent [19]

Yoo

[11] Patent Number: 5,573,242

[45] Date of Patent: Nov. 12, 1996

[54] RACKET WITH RUGGED FRAME

[76] Inventor: Suk Ho Yoo, 9-903 Gaspo 1st Woosung Apt., 503 Daechi Dong, Kangnam-Gu, Seoul, Rep. of Korea

[21] Appl. No.: 419,535

[22] Filed: Apr. 10, 1995

[30] Foreign Application Priority Data

Apr. 11, 1994 [KR] Rep. of Korea ..... 94-7465

[51] Int. Cl.[6] ..... A63B 49/02

[52] U.S. Cl. ..... 273/73 C

[58] Field of Search ..... 273/73 R, 73 C, 273/73 D, 73 E, 73 H

[56] References Cited

U.S. PATENT DOCUMENTS

| | | | |
|---|---|---|---|
| 1,451,836 | 4/1923 | Larned | 273/73 H |
| 1,541,828 | 6/1925 | Larned | 273/73 H |
| 1,750,727 | 3/1930 | Norton | 273/73 H |
| 2,282,195 | 5/1942 | Compte | 273/73 C |
| 2,626,804 | 1/1953 | Robinson | 273/73 H X |
| 3,568,290 | 3/1971 | Carlton | 273/73 C X |
| 4,177,990 | 12/1979 | Kajiwara | 273/73 C |
| 4,280,699 | 7/1981 | Drake | 273/73 C |
| 5,183,265 | 2/1993 | Umlauft et al. | 273/73 C |
| 5,386,991 | 2/1995 | Rochette | 273/73 C X |

FOREIGN PATENT DOCUMENTS

| | | | |
|---|---|---|---|
| 4022187 | 1/1991 | Germany | 273/73 C |
| 2056863 | 3/1981 | United Kingdom | 273/73 C |
| 2262892 | 7/1993 | United Kingdom | 273/73 C |

*Primary Examiner*—William E. Stoll
*Attorney, Agent, or Firm*—Keck, Mahin & Cate

[57] ABSTRACT

A racket with a rugged frame adapted to be used in various games such as tennis, badminton, racket ball, squash tennis and etc. The racket includes a handle, a frame, and power reinforcing portions and flexible portions formed along a part of the frame or the entire frame in an alternating manner, each of the power reinforcing portions being constituted by a protruded frame portion having a relatively large side thickness while each of the flexible portions being constituted by a depressed frame portion having a relatively small side thickness, thereby capable of eliminating an insufficient power of the conventional classic type construction and an insufficient flexibility of the conventional wide body type construction, and attenuating a vibration generated when a ball strikes against the racket, thereby reducing an impact while providing a good ball striking feeling. In particular, the racket can control the flexibility and power appropriately depending on the feature of a user by adjusting the difference in thickness between the power reinforcing portion and the flexible portion both constituting the rugged frame construction and the number of protrusions and depressions respectively constituting the power reinforcing portions and the flexible portions.

6 Claims, 3 Drawing Sheets

RACKET WITH RUGGED FRAME

BACKGROUND OF THE INVENTION

1. Field of the Invention

The present invention relates to a racket, and more particularly to a racket with a rugged frame adapted to be used in various games such as tennis, badminton, racket ball, squash tennis and etc.

2. Description of the Prior Art

Rackets used in tennis, badminton, racket ball and squash tennis games have a common construction including a handle, a frame and a string tied along the frame even though they have a slight difference from one another in terms of size and shape. For a simplicity of description, the following description, therefore, will be made only in conjunction with tennis racket.

Generally, tennis rackets are classified into classic racket and wide body racket. They are distinguished from each other in terms of the side thickness of the frame. That is, rackets having a thickness of about 1.5 cm to about 2.0 cm are called the classic racket while rackets having a thickness larger than that of the classic racket is called the wide body racket.

FIG. 1 illustrates a state when a ball strikes against the conventional racket of the classic type.

Since the classic racket has a relatively small frame thickness, the frame is freely flexed at the moment a ball strikes against the racket. As a result, the ball can stay at the racket longer time. By virtue of such a longer stay time of the ball, it is possible to obtain a sufficient time to control the advance direction and position of the ball. That is, the classic racket has an advantage of an easy ball control. By virtue of such an advantage, the classic racket is mainly favorite to professional players acting a high level play such as drive or top spin.

In spite of the advantage, the classic racket has a disadvantage of a weak power (a weak resilience of ball). Due to such a disadvantage, the loss of the physical strength of the player is increased where the racket is used long time. Consequently, it is difficult for persons with a low physical power to use the classic racket.

Recently, the wide body racket eliminating the disadvantage of the classic racket has been favorite to amateurs, in particular, female players or children. This is because the wide body racket ensures a superior power by virtue of a relatively large thickness of its frame, as compared to the classic racket.

However, this wide body racket also have the following disadvantages:

First, it is difficult to control the ball. FIG. 2 illustrates a state when a ball strikes against the conventional racket of the wide body type. Since the frame of the wide body racket is thick, it is hardly flexed at the moment the ball strikes against the racket, as shown in FIG. 2. As a result, the ball stays at the racket very short time. Due to such a very short stay time of the ball, it is difficult to control the ball. It is also difficult for a player to act a high level play.

Second, a high impact is directly transferred to the player's arm at the moment the ball strikes against the racket because the frame is hardly flexed. As a result, the player is susceptible to a tennis elbow or a wrist injury. In other words, the wide body racket has a disadvantage of an increased danger of an injury because it can not absorb the impact generated upon the striking of ball at its frame, so that the impact is directly transferred to the player's arm.

For this reason, professional and experienced players are unwilling to use the wide body racket. They use the classic racket in spite of the significant drawback of the classic racket.

SUMMARY OF THE INVENTION

Therefore, an object of the invention is to eliminate the above-mentioned problems encountered in two types of the conventional rackets and, thus, to provide a racket of a new type capable of exhibiting both a flexibility and a power.

Another object of the invention is to provide a racket of a new type capable of controlling a flexibility and a power depending on the feature of a user.

Another object of the invention is to provide a racket of a new type capable of reducing an impact generated when a ball strikes against the racket and providing a good feeling of a ball striking.

In accordance with the present invention, this object can be accomplished by providing a racket comprising a handle and a frame, further comprising: power reinforcing portions and flexible portions formed along a part of the frame or the entire frame in an alternating manner, each of the power reinforcing portions being constituted by a protruded frame portion having a relatively large side thickness while each of the flexible portions being constituted by a depressed frame portion having a relatively small side thickness.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
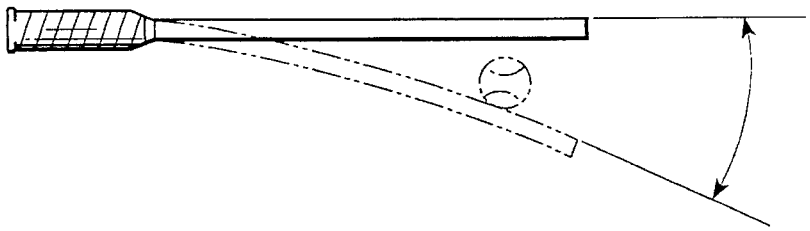
FIG. 1 is a side view of a conventional racket of the classic type, illustrating a state when a ball strikes against the racket.
Figure 2:
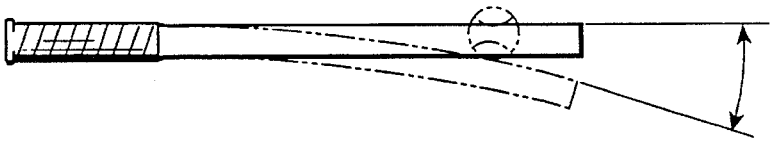
FIG. 2 is a side view of a conventional racket of the wide body type, illustrating a state when a ball strikes against the racket.
Figure 3:
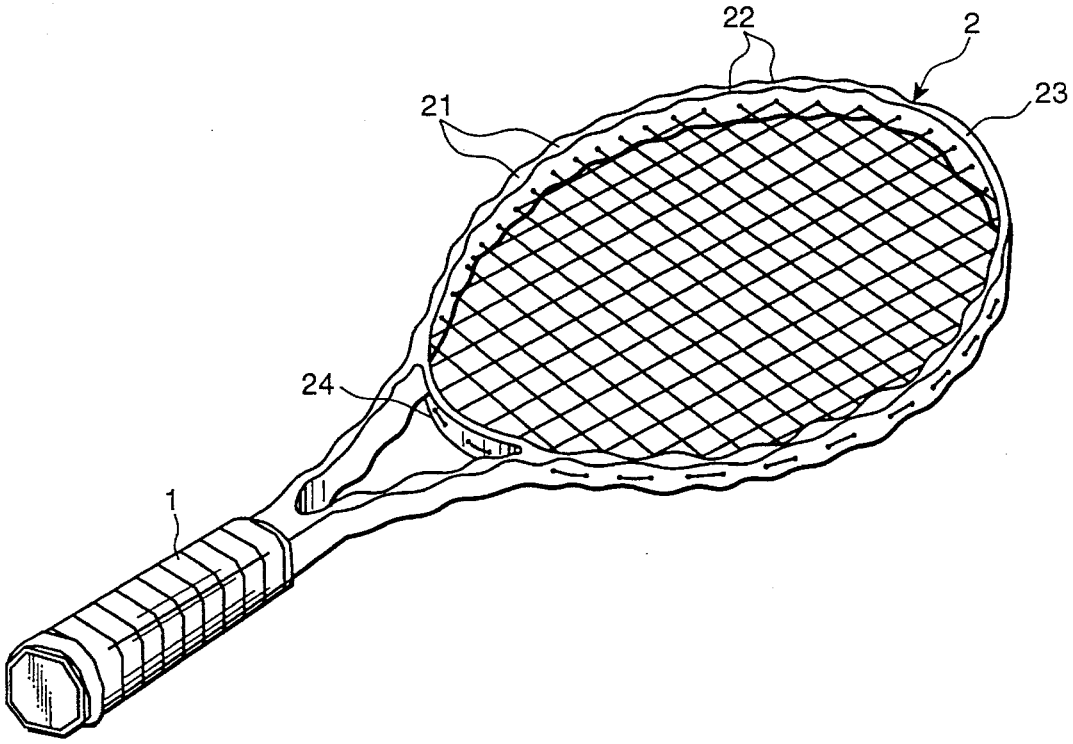
FIG. 3 is a perspective view of a racket in accordance with a first embodiment of the present invention.
Figure 4:
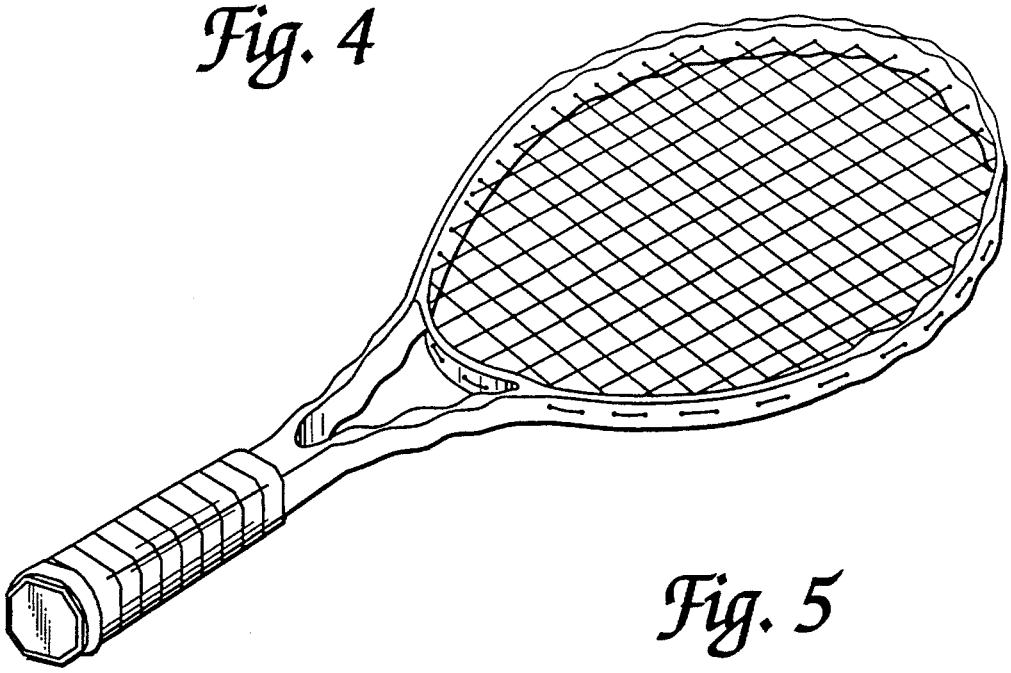
FIG. 4 is a perspective view of a racket in accordance with a second embodiment of the present invention.
Figure 5:
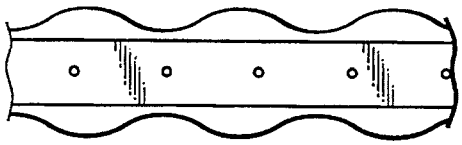
FIG. 5 is a sectional view of a part of a racket in accordance with a third embodiment of the present invention.
Figure 6:
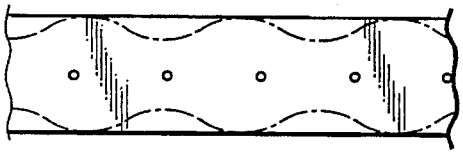
FIG. 6 is a sectional view of a part of a racket in accordance with a fourth embodiment of the present invention.
Figure 7:
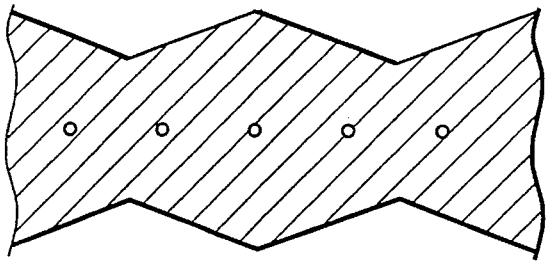
FIG. 7 is a sectional view of a part of a racket in accordance with a fifth embodiment of the present invention.
Figure 8:
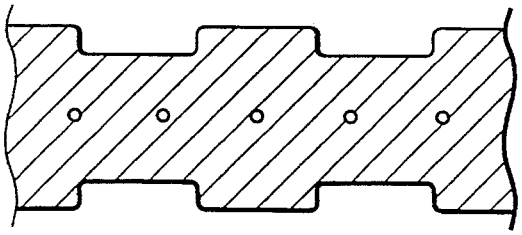
FIG. 8 is a sectional view of a part of a racket in accordance with a sixth embodiment of the present invention.
Figure 9:
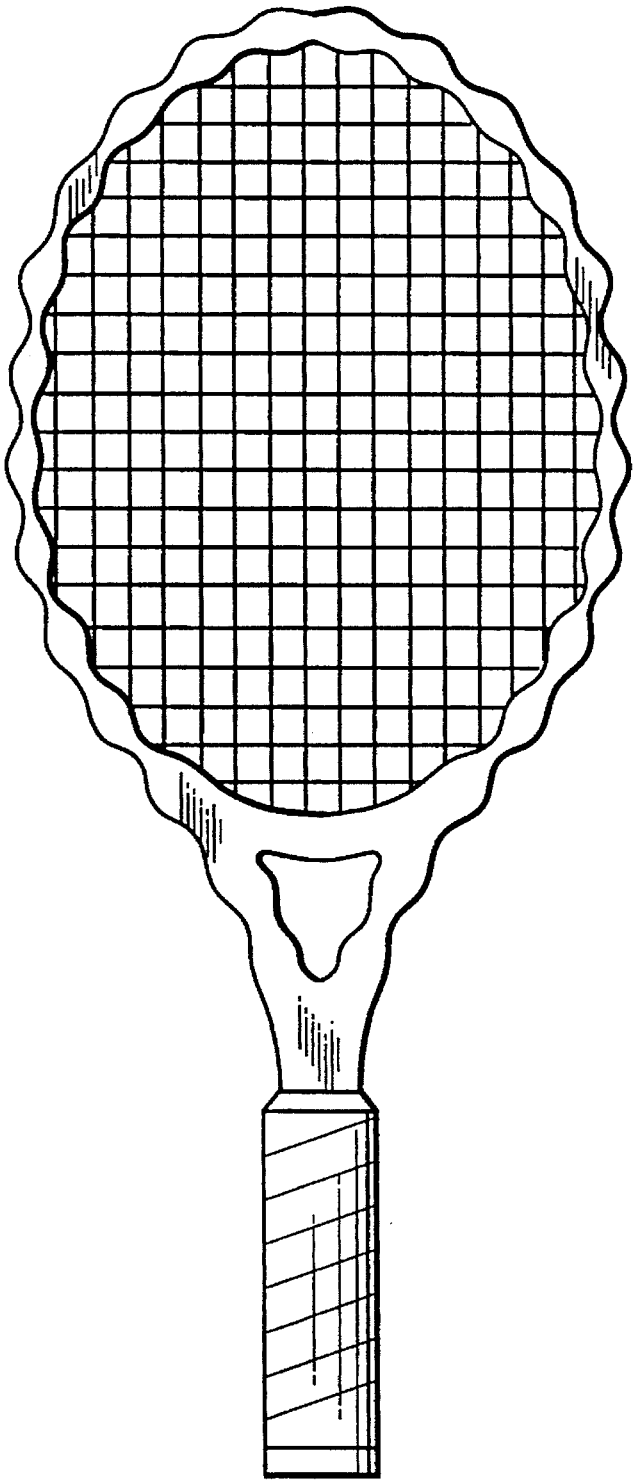
FIG. 9 is a front view of a racket in accordance with a seventh embodiment of the present invention.

FIGS. 3 to 9 illustrate various racket constructions in accordance with different embodiments of the present invention, respectively. FIG. 3 is a perspective view illustrating a racket with a rugged construction provided at its entire frame in accordance with a first embodiment of the present invention. FIG. 4 is a perspective view illustrating a racket with a rugged construction provided at a part of its frame in accordance with a second embodiment of the present invention. FIG. 5 is a sectional view of a part of a racket with a rugged construction provided at its frame of the conventional classic construction in accordance with a third embodiment of the present invention. FIG. 6 is a sectional view of a part of a racket with a rugged construction provided at its frame of the conventional wide body construction in accordance with a fourth embodiment of the present invention. FIG. 7 is a sectional view illustrating a part of a racket with a rugged frame construction having triangular protrusions and depressions in accordance with a fifth embodiment of the present invention. FIG. 8 is a sectional view illustrating a part of a racket with a rugged frame construction having rectangular protrusions and depressions in accordance with a sixth embodiment of the present invention. FIG. 9 is a front view illustrating a racket with a rugged frame construction having lateral protrusions and depressions in accordance with a seventh embodiment of the present invention.

In accordance with the first embodiment of the present invention shown in FIG. 3, the racket has a rugged frame having power reinforcing portions 21 and flexible portions 22 formed along the frame in an alternating manner repeatedly. Each of the power reinforcing portions 21 is constituted by a protruded frame portion having a relatively large side thickness while each of the flexible portions 22 is constituted by a depressed frame portion having a relatively small side thickness. By such a rugged frame construction, in particular, the flexible portions 22, the racket is smoothly flexed at the moment a ball strikes against the racket. Accordingly, the rugged frame attenuates a vibration generated when the ball strikes against the racket. As a result, it is possible to protect a user from an injury of his arm. Since the ball can stay at the racket long time by virtue of the flexibility of the frame, it can be more accurately controlled. Furthermore, the attenuation in vibration makes the ball striking feeling good. Under the condition that the impact is absorbed as mentioned above, the user can strike the ball powerfully by virtue of the function of the power reinforcing portions 21.

The rugged construction may be provided at the entire frame, as shown in FIG. 3. Alternatively, the rugged construction may be provided at a part of the frame, as shown in FIG. 4. Such a rugged construction also may be incorporated in the conventional classic type frame as shown in FIG. 5 or in the conventional wide body type frame as shown in FIG. 6. For obtaining a more high flexibility, the racket may have a rugged frame construction including lateral protrusions and depressions formed along the inner and outer surfaces of the frame. Such a construction is shown in FIG. 9.

As the difference in thickness between the power reinforcing portion 21 and the flexible portion 22 is increased, the frame has an increased flexibility. The flexibility of the frame can be also increased as the number of protrusions and depressions is increased. The number of protrusions and depressions capable of providing a proper flexibility and a proper power is 5 to 30, and preferably 10 to 20. It is also preferred that the protrusions and depressions have an arc shape. Of course, the protrusions and depressions may have a triangular shape as shown in FIG. 7 or a rectangular shape as shown in FIG. 8.

For more reinforcing the power, the racket may have an upper frame reinforcing portion 23 provided at the upper portion of the frame or/and a lower frame reinforcing portion 24 provided at the lower portion of the frame. These frame reinforcing portions 23 and 24 are formed by forming the corresponding portions of the frame to have a larger thickness than other portions of the frame. Although these frame reinforcing portions 23 and 24 are not the portions to be resisted against the flexure generated when the ball strikes against the racket, they are desirable to have an arc shape with a more or less large width so as to increase their durability because they may be weaken due to the repetitive impact generated by the ball.

Although the present invention has been described in conjunction with the tennis racket for a convenience of description, it is not limited to the tennis racket. The present invention may be equivalently applied to other types of rackets such as badminton, racket ball, squash tennis and etc.

As apparent from the above description, the present invention provides a racket having a rugged frame construction capable of eliminating an insufficient power of the conventional classic type construction and an insufficient flexibility of the conventional wide body type construction, and attenuating a vibration generated when a ball strikes against the racket, thereby reducing an impact while providing a good ball striking feeling. In particular, the racket of the present invention can control the flexibility and power appropriately depending on the feature of a user by adjusting the difference in thickness between the power reinforcing portion and the flexible portion both constituting the rugged frame construction and the number of protrusions and depressions respectively constituting the power reinforcing portions and the flexible portions.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A racket comprising a handle and a frame, further comprising:

power reinforcing portions and flexible portions formed along at least a part of the frame with at least some of said portions on the head of the frame in an alternating manner, the power reinforcing portions being constituted by a plurality of convex arc-shaped, protruded frame portions extending opposite to each other above and below a plane of the frame, said power reinforcing portions each having equal relatively large frame thickness as measured in a direction perpendicular to the plane of the frame and the flexible portions being constituted by a plurality of opposite concave arc-shaped, depressed frame portions disposed between said power reinforcing portions, said flexible portions each having equal relatively small frame thickness as measured in a direction perpendicular to a plane of the frame;

wherein there are 10 to 25 power reinforcing portions and 10 to 25 flexible portions alternately along the frame.

2. A racket in accordance with claim 1, further comprising lateral inner and outer power reinforcing portions and lateral inner and outer flexible portions formed along outer and inner surfaces of the frame opposite to each other in a direction parallel to the plane of the frame.

3. A racket comprising a handle and a frame, further comprising:

power reinforcing portions and flexible portions formed along at least part of the frame with at least some of said portions on the head of the frame in an alternating manner, the power reinforcing portions being constituted by a plurality of triangular-shaped, protruded frame portions extending opposite to each other above and below a plane of the frame, said power reinforcing portions each having equal relatively large frame thickness as measured in a direction perpendicular to a plane of the frame and the flexible portions being constituted by a plurality of opposite triangular-shaped, depressed frame portions, disposed between said protruded frame portions, said flexible portions each having equal relatively small frame thickness measured in a direction perpendicular to a plane of the frame;

wherein each said power reinforcing portion and each said flexible portion has a same frame thickness respectively, and there are 10 to 25 power reinforcing portions and 10 to 25 flexible portions alternately along the frame.

4. A racket in accordance with claim 3, further comprising lateral power reinforcing portions and lateral flexible portions formed along outer and inner surfaces of the frame in a direction parallel to the plane of the frame.

5. A racket comprising a handle and a frame, further comprising:

power reinforcing portions and flexible portions formed along at least a part of the frame with at least some of said portions on the head of the frame in an alternating manner, the power reinforcing portions being constituted by a plurality of rectangular-shaped, protruded frame portions extending opposite to each other above and below a plane of the frame, said power reinforcing portions each having equal relatively large frame thickness as measured in a direction perpendicular to a plane of the frame and the flexible portions being constituted by a plurality of opposite rectangular-shaped, depressed frame portions disposed between said power reinforcing portions, said flexible portions each having equal relatively small frame thickness measured in a direction perpendicular to a plane of the frame;

wherein each said power reinforcing portion and each said flexible portion has a same frame thickness respectively, and there are 10 to 25 power reinforcing portions and 10 to 25 flexible portions alternately along the frame.

6. A racket in accordance with claim 5, further comprising lateral power reinforcing portions and lateral flexible portions formed along outer and inner surfaces of the frame in a direction parallel to the plane of the frame.

* * * * *